United States Patent [19]

Fleissner

[11] 4,077,466

[45] Mar. 7, 1978

[54] HEATED ROLL, SUCH AS A GODET, IN DRAWING UNITS, FOR EXAMPLE

[75] Inventor: Hans Fleissner, Riehen, Switzerland

[73] Assignee: Vepa AG, Switzerland

[21] Appl. No.: 625,002

[22] Filed: Oct. 23, 1975

[30] Foreign Application Priority Data

Oct. 23, 1974 Germany ..... 2450241
Nov. 9, 1974 Germany ..... 2453282

[51] Int. Cl.[2] ..... F28F 13/06

[52] U.S. Cl. ..... 165/89; 34/124; 69/30

[58] Field of Search ..... 165/87–89; 34/124, 125; 69/30

[56] References Cited

U.S. PATENT DOCUMENTS 2,582,365 1/1952 Westphal ..... 165/89
3,903,961 9/1975 Stanislaw ..... 165/89

*Primary Examiner*—Charles J. Myhre
*Assistant Examiner*—Theophil W. Streule, Jr.
*Attorney, Agent, or Firm*—Craig & Antonelli

[57] ABSTRACT

A heated roll for effecting heat treatment of materials has an outer cylindrical shell, an inner cylindrical shell spaced from the outer cylindrical shell, a wall defining an annular space between the shells, partitions in the annular space for forming flow channels for the heating medium passing through the inner space, feed means for introducing a heating medium into the annular space and a discharge means for discharging the heating medium from the annular space and from the roll. The discharge means includes a centrally located backflow conduit and defines a single stationary discharge opening arranged in the roll below the roll axis for discharging heating medium selectively from the lower portion of the roll to the centrally located backflow conduit.

40 Claims, 8 Drawing Figures

HEATED ROLL, SUCH AS A GODET, IN DRAWING UNITS, FOR EXAMPLE

This invention relates to a heated roll for the heat treatment of materials of any desired kind, such as a godet in drawing units utilized especially for synthetic fibers, and cylindrical dryers with an annular space provided between an outer shell and an inner shell, partitions being preferably arranged in this annular space to form flow channels for the heating medium to be fed and finally also to be discharged.

BACKGROUND OF THE INVENTION

There are two primary basic constructions of godets heated by means of steam for drawing units, for example. One construction is the hollow-space godet wherein the superheated steam is fed into the inner space thereof without any guidance. During the cooling of the steam, a condensate is formed which, with the godet being rotated, is distributed as a liquid film over the entire inner surface of the godet. Since the water prevents the further heating of the godet, and even cools the wall surface, a continuous discharge possibility must be provided. For discharge purposes, a kind of siphon pipe is arranged; several of these siphon pipes extend, in most cases, distributed over the length of the roll up to the close proximity of the inner wall surface of the godet, and they do not rotate together with the godet. The suction openings of the pipes are arranged at the lower apex of the godet and discharge the condensate even if the godet is at a standstill. If the thickness of the film reaches the mouths of the pipes, the condensate is removed up to a residual minimum by a pressure differential under the effect of the steam which is fed to the unit. Thus, it is quite impossible to remove the condensate entirely by means of this construction; especially the condensate cannot be discharged laterally or between the individual siphon pipes. Furthermore, a large amount of steam escapes also by way of the condensate discharge pipe and thus is lost for heating the godet. An increase in steam consumption is the consequence thereof. Another disadvantage of this hollow-space godet is the low flow velocity of the steam so that, in any event, a uniform heating of the wall surface to a high temperature is impossible.

In addition, to the hollow-space godet, the more advantageous double-walled godet is conventional, consisting of an outer shell and an inner shell, between which a free annular space is provided for receiving the heating medium. In parallel to the godet axis, bars, partitions, or the like are arranged in the free annular space, subdividing the annular space into several parallel-disposed flow channels; preferably, respectively two adjacent flow channels are in communication with each other at one end. At the other end, the heating medium is then fed to one of these longitudinal chambers and is removed from the other longitudinal chamber. This results in a uniform temperature distribution over the wall surface of the godet. The flow velocity of the steam through the channels is high, so that a high godet wall temperature can also be attained.

A disadvantage in this godet construction is that the condensate, which is formed in all cases, can be forced out or removed by suction essentially only through the action of the subsequently fed steam along its way through the adjacent flow channels, and must then be conducted to the central discharge conduit by way of bores in the end wall of the roll associated with each longitudinal chamber and being of a smaller cross section. Under unfavorable conditions during operation, there is thus the danger that temporarily differing resistances are built up in the individual flow channels, which impede the flow of the steam in the channels, and this, in turn, can interfere with the homogeneity of the temperature distribution. Besides, there is the further disadvantage that, when the godet is at a standstill, the condensate, which has formed, accumulates in the lower half of the annular chamber and fills the latter to a maximum. The condensate can be discharged only after the godet has once again commenced its operation.

The ideal, constituting a genuine combination of the favorable features of the hollow-space godet, namely the arrangement of a stationary condensate discharge pipe, with the advantages of a double-walled godet, namely a uniform temperature distribution and a high steam flow velocity, has not as yet been attainable, because the arrangement of a stationary condensate discharge pipe is impossible if the free annular space between the two shells is to be subdivided into individual flow channels.

This invention is based on the problem of maintaining the idea of combining the conventional double-walled godet, if at all possible, with flow channels and a single heating medium discharge pipe, and of finding a solution for this combination.

Starting with the roll as described above, the simple solution, which has so long been searched for, resides in that a single discharge conduit is provided in the roll for removing the heating medium flowing through all flow channels. Preferably, as in the hollow-space godet, the discharge conduit is a pipe stationary with respect to the roll, the suction opening of this pipe being arranged in the immediate vicinity of the outer roll shell or wall. In this connection, the suction opening of the discharge conduit should be arranged vertically below the roll axis, so that even if the roll is at a standstill the entire amount of the thus-formed condensate can be continuously removed.

It would also be advantageous to provide a godet wherein the condensate can be continuously and completely removed without a stationary condensate discharge pipe, while the godet is rotating and also while the godet is at a standstill, namely without the necessity of feeding an increased amount of steam.

In a development of the basic idea of the present invention, this object is attained by providing that the operative heating medium discharge conduit consists of a single, rotating condensate conduit which connects the annular space with a central backflow line. The basic idea, therefore, resides in arranging only a single conduit for the removal of the condensate — just as the siphon pipe in case of the hollow-space godet— but this conduit is now to rotate together with the roll and is to collect, during its travel, the thus-formed condensate. In a preferred embodiment, there is not only a single condensate conduit, but a plurality of bores arranged in a stellate pattern in the bottom of the roll, among which, however, only the respectively operative condensate conduit is in communication with the central backflow line. The respectively operative conduit should always be arranged on the underside of the roll, so that even with the roll at a standstill the condensate formed over the entire wall surface can be removed without difficulties.

The advance in the art provided by the present invention is clearly apparent. The aforementioned advantages of the double-walled godet have been retained, namely a good temperature distribution at a high steam flow velocity in the free annular space, namely unchanged over the entire length of the roll. The removal of the condensate, however, has now been made independent of the velocity of the subsequently fed steam; rather, the condensate will collect in the individual heating medium discharge conduits arranged in a stellate pattern while the conduits are rotating, and the condensate will be discharged only when the individual conduit is connected to the central backflow line. Thus, the condensate is forced out of each discharge conduit in a short period of time by the steam pressure and the thus-operative condensate conduit is immediately subsequently closed off again, so that steam still unused for heating purposes cannot escape through the conduit which has been cleared of condensate. Accordingly, in addition to ensuring a flawless temperature distribution, a minor steam consumption is likewise attained.

A very essential further advantage resides in the possibility of being able to discharge the condensate basically entirely during the operation of the roll, i.e., during rotation, as well as during its standstill. If the operative condensate conduit is always provided at the bottom, by arranging only at that location a constant communication with the central heating medium backflow line, the condensate forming along the entire wall or shell surface will flow downwardly into the zone of the operative condensate conduit and will be removed continuously through the action of the pressure differential of the steam. Thus, the inner wall of the roll is always free of condensate, namely also free of a condensate film, so that the temperature distribution is always constant.

In a further development of this idea of constructing an internally heated roll, the present invention furthermore provides that a sealing cap or head is arranged for concomitant rotation at the end of the central backflow line in the region of the plurality of rotating discharge conduits radially disposed in the bottom of the roll; this sealing cap has only on the underside a connecting line which connects the discharge conduit respectively located at the bottom with the central backflow line. This sealing cap thus represents the control element for the discharge of the condensate at the desired location in the roll. By means of this sealing cap, all other backflow lines except for the operative condensate line are sealed off, but one after the other is opened for removing the thus-collected condensate.

The connecting line in the sealing cap must have a cross section ensuring the uninterrupted discharge of the condensate, even in those cases when the opening of a heating medium discharge conduit is covered only partially by the associated opening of the connecting line in the sealing cap. For this reason, the opening of the connecting line in the sealing cap should in any event be larger than the cross section of a discharge conduit. It is most advantageous to fashion the cross section of the opening of the connecting line approximately equally large as the cross section of a discharge conduit plus the area between two adjacent heating medium discharge conduits. In such a case, a discharge conduit will definitely be always in communication with the connecting line and thus with the central backflow line. The most unfavorable case occurs if a discharge conduit is not as yet entirely sealed off by the sealing cap, while the subsequent discharge conduit is already in communication with the opening in the sealing cap. However, with such a size of the opening of the connecting line, a removal of the condensate through the central backflow line is ensured at any position of the roll selectively to the stationary sealing cap.

In order to be able to discharge the condensate formed in the unit in its entirety in the zone of each heating medium discharge conduit, it is advantageous to make the diameter of the free annular space in the zone of the discharge conduits larger than the diameter in the zone of the remaining wall surface. Thus, an annular groove is milled into the shell of the roll in the region of the discharge conduits; this groove will be entered by the condensate and the latter will be completely removed by suction therefrom through the discharge conduits, which have a greater length. A still stronger siphon is produced if the annular space of the roll is conducted by way of a siphon-like elbow in the shell of the roll with the respective discharge conduit. Thereby, the steam always exerts pressure on the surface of the condensate collected at the end of the roll. A consequence of this construction is a total removal of the water without any residue.

The suction opening of the heating medium discharge conduit can be arranged on the flange side of the roll if the roll is mounted in an overhung position. However, it is more advantageous to provide the suction opening of the heating medium discharge conduit on the free end face of the roll. For this purpose, a wall is advantageously arranged at the end of the roll, extending at right angles through the roll and separating the flow channels, i.e., the substantially active portion of the roll, from a heating medium discharge chamber. The heating medium discharge conduit in this discharge chamber is then to penetrate this wall to be able to remove the taken-in condensate from the godet though a central heating medium discharge line.

A particular advantage of the construction of this invention is the possibility of being able to form flow channels in the free anular space between the two roll shells. This can be accomplished, for example, by providing the heating medium feed lines for a plurality of flow channels along the roll shell in the zones of this wall penetrated by the heating medium discharge line. One embodiment could reside in fashioning the individual feed lines for the flow channels as radial bores in the wall. Starting at the openings of the heating medium feed lines, a flow channel is extended in each case along the godet shell surface up to the flange side of the godet. From there, a connection must make it possible for the heating medium to continue its flow in parallel to the first-mentioned flow channels in so-called backflow channels. The backflow channels then terminate freely in the heating medium discharge chamber. Thus, in spite of the flow channels present in this arrangement, the thus-formed condensate will always collect in the heating medium discharge chamber, no matter whether the roll is rotating or at a standstill. Also, the conveyance of the condensate does not require an oversupply of steam, since the cross sections for the discharge of the condensate can be made of a very large size.

The above-defined roll construction is not only suitable for steam as the heating medium, but also, without alterations, for liquid heating media.

BRIEF DESCRIPTION OF THE DRAWINGS

The drawing shows one example of the roll construction according to this invention. Still further details of the invention will be explained in the construction with reference to this example. All of the features per se are of inventive significance, but are also of great interest in a combination with one another. In the drawings.

Figures 1, 2, 3, 4, 5:
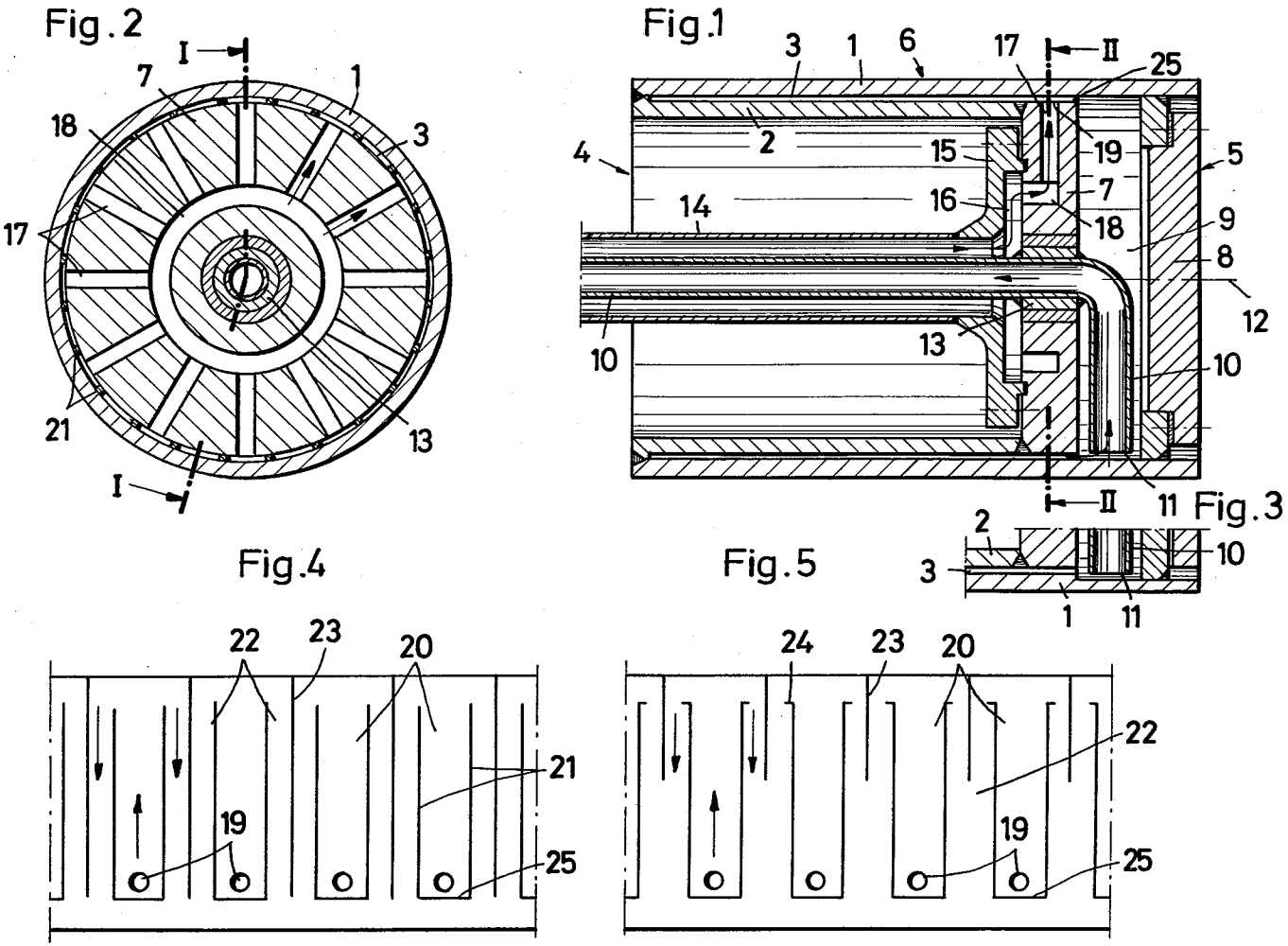
FIG. 1 shows a section along line I—I according to FIG. 2 longitudinally through a unilaterally supported godet.
FIG. 2 shows a section through the unit of FIG. 1 along line II—II.
FIG. 3 shows a detail on the underside of the godet according to FIG. 1 in a different configuration.
FIG. 4 shows a top view of the planar projection of the free annular space.
FIG. 5 likewise shows a view of the planar projection of the free annular space with a different configuration of the partitions.

The heated roll — denoted a godet in this description — as shown in FIG. 1 consists of an outer roll shell 1 arranged at a spacing from the inner roll shell 2 in order to form a free annular space 3. This double-walled construction is rotatably arranged on a stand at the end face 4. The godet extends in an overhung position from this stand and accordingly is not supported at the other end face 5. The active shell surface 6 serving for the heating of synthetic fiber strands is bounded at the free end of the godet by a wall 7. This wall 7 is arranged in parallel and at a spacing from the roll cover 8 at the end face, so that a heating medium discharge chamber 9 is formed between these walls.

A stationary condensate discharge conduit 10 extends into the heating medium discharge chamber 9; this conduit passes centrally along the godet axis 12 and is bent downwardly within the condensate discharge chamber 9 so that it terminates with its opening 11 vertically below the roll axis 12 in the immediate vicinity of the inner surface of the outer shell 1. It is possible, as shown in FIG. 3, to cut the diameter of the inner surface of the outer shell 1 larger than the diameter of the inner surface of the outer shell 1 in the zone of the free annular chamber 3. By this measure, the complete discharge of the condensate within the free annular space 3 is ensured. There will merely remain a film in correspondence with the spacing between the opening 11 of the condensate discharge pipe 10 and the inner surface of the outer shell 1 in the zone of the condensate discharge chamber 9 according to FIG. 3. However, this film is without significance for the function of the godet.

The condensate discharge pipe 10 is supported in a bearing 13 centrally within the wall 7. In relation to this non-rotatable bearing 13, the wall 7 rotates together with the godet. The condensate discharge pipe 10 is centrally surrounded by a condensate feed pipe 14. The feeding as well as the discharging of the heating medium thus take place in the free end face of the godet.

For feeding the heating medium into the free annular chamber 3, a flanged lid 15 is attached at the end of the heating medium feed pipe 14, this lid, in turn, being threadedly connected to the wall 7. Between the wall 7 and the flanged lid 15, an annular chamber 16 is provided, by way of which the heating medium flows to a plurality of radial bores 17 in the wall 7. The radial bores are particularly apparent from FIG. 2. They are arranged in a stellate pattern and distribute the heating medium uniformly over all flow channels in the annular space 3. The radial bores 17 are in communication with the annular chamber 16 in the flanged lid by way of an annular groove 18.

The construction within the free annular space 3 must, on the one hand, ensure the uniform temperature distribution and prevent fresh heating medium from immediately entering the condensate discharge chamber 9. The openings 19 of the individual radial bores 17 can be seen especially from FIGS. 4 and 5. In the zone of these openings, a flow channel 20 commences in each case, the channel 20 being formed by lateral partitions 21 and closed off with respect to the condensate discharge chamber 9 by another partition 25. The heating medium thus will flow along this U-shaped flow channel 20 in the direction toward the flange side of the godet. At the end of this flow channel 20, the heating medium is divided and returns via backflow chambers 22 arranged in parallel on both sides thereof in the direction of the condensate discharge chamber 9. The cross section of the flow channels in unlimited especially in the direction of the condensate discharge chamber, so that a removal of the condensate without special expenditure of steam is ensured.

The construction of the subdivided channels can be varied in accordance with FIG. 5 by providing that the partition 23 between the adjacent backflow spaces 22 does not terminate in the region of the end of the individual flow channels, but a greater distance in front thereof so that a common backflow path is provided for the cooled-down steam and for the condensate. At the end of the partitions of the flow channels 20, baffles 24 are arranged in accordance with FIG. 5 to produce a turbulence in the heating medium. These baffles can consist of sheets bent at an angle or can also have some other configuration.

Figure 6:
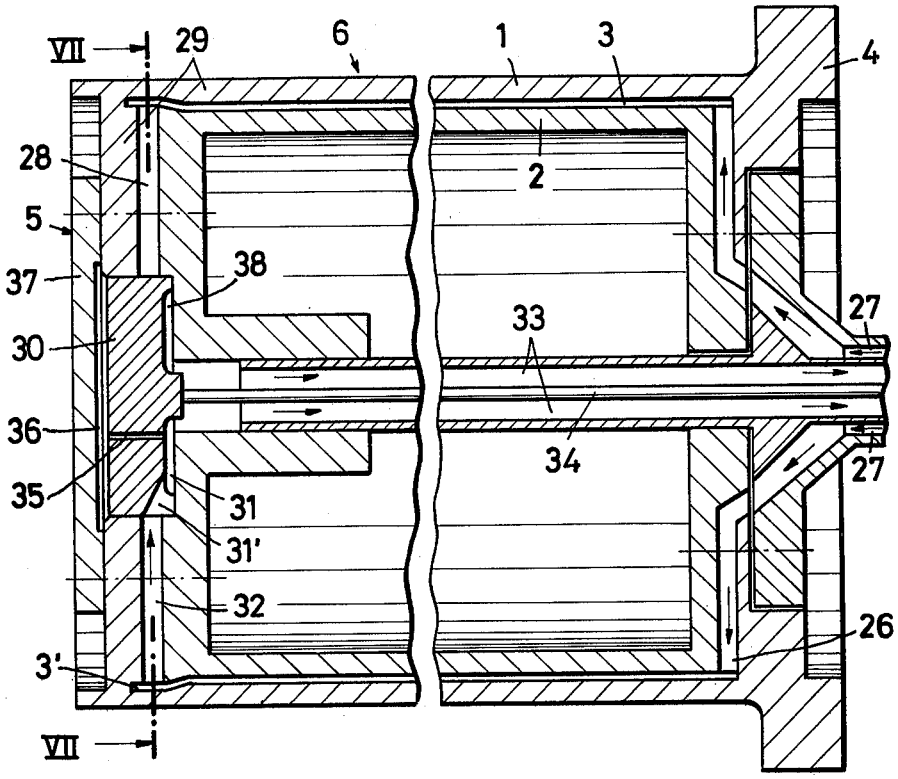
FIG. 6 shows a section along an interiorly heated roll of a different construction.

The roll illustrated in FIG. 6 consists of an outer shell 1 which can be rotatably mounted by way of the flange 4 to a stand, not shown. At a spacing from the outer roll shell 1, an inner roll shell 2 is likewise arranged in this embodiment centrally with respect to the axis of the roll in order to form a free annular space 3. The free annular space 3 is connected on the end face facing the flange 4 with the central heating medium feed line 27 in the axle of the roll, by way of a plurality of heating medium feed lines 26 arranged in a stellate pattern. Through these heating medium feed lines 26 the continuous introduction of heating medium, such as superheated steam, is ensured along the indicated arrows, distributed uniformly over the entire free annular space 3.

Figure 7:
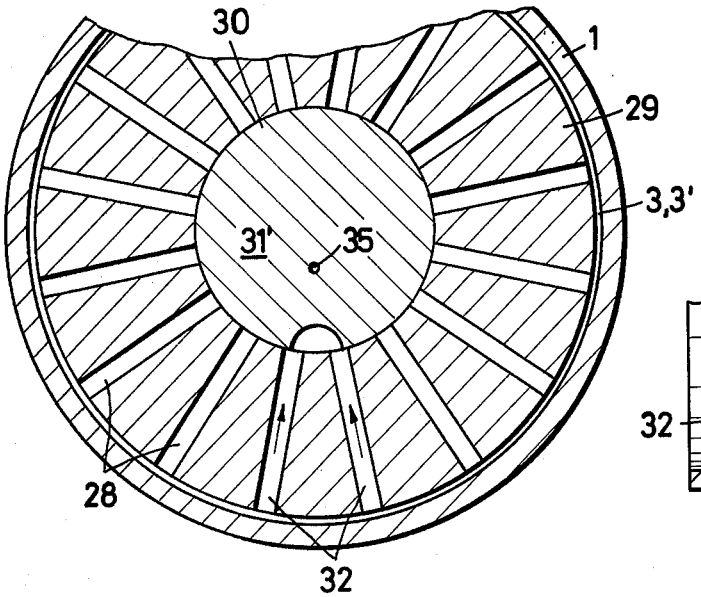
FIG. 7 shows a section at right angles through the embodiment of FIG. 6 along line II—II.

The discharge of the heating medium takes place by way of heating medium discharge conduits 28 arranged on the other end face of the roll and disposed in the bottom 29 of the roll likewise in a radial orientation. FIG. 7 shows the stellate arrangement of the heating medium discharge conduits 28. The heating medium feed lines 26 can be drilled in the same manner into the other end face of the roll. The discharge of the heating medium does not take place by way of all discharge conduits 28 at the same time, i.e., differently from the feeding of the heating medium through conduits 26. Rather, except for one or optionally two heating medium discharge conduits, all other conduits 28 are sealed off by the centrally arranged sealing cap 30. For this purpose, the heating medium discharge conduits 28, disposed in a stellate pattern, terminate on the outer shell surface of the sealing cap 30, the latter having a connecting line 31 between the heating medium discharge conduit 32 located respective at the bottom and the central backflow line 33, this connecting line being only vertically below the roll axis.

To provide that the connecting line 31 in the sealing cap 30 is always arranged at the bottom, the sealing cap must be stationary, whereas the roll is rotating. For this purpose, the scaling cap 30 is held from rotation by way of a rod 34 longitudinally through the central backflow line 33. The rod 34 can also be fashioned as a pipe.

The construction of the roll is, therefore, so that the condensate can collect all around the roll in the individual heating medium discharge conduits, but the collected condensate can be removed in all cases only in one, or according to FIG. 7 in two, operative condensate lines 32, namely when such condensate lines are in communication with the connecting line 31 in the sealing cap 30. Once this connection of a heating medium discharge conduit 28 with the central backflow line 33 is established by the rotation of the roll in the lower apex of the roll, then the condensate is suddenly forced, by a pressure differential, from the condensate line 32 and thus is removed. Any excess flow of steam through the presently operative condensate line 32 is prevented, because this operative condensate line 32, after all, rotates further about the roll axis and is immediately subsequently sealed off again by the sealing cap to give way to a following line for removal of the condensate collected therein.

The sealing cap 30 is arranged completely relieved of pressure in the bottom 29 of the roll. For this reason, any wear and tear on the cap due to the relative motion will be minimal. For this purpose, the bore 35 is, on the one hand, arranged transversely through the cap, placing the free space 36 between the sealing lid 37 and the bottom 29 in communication with the steam pressure in the central backflow line 33. Also, the steam pressure is ambient uniformly over the area of the sealing cap 30 associated with the central backflow line 33; this is effected by cutting grooves 38 — although without function — across the surface area. Furthermore, the steam pressure is effective over the entire peripheral area of the sealing cap, namely through all mouths of the heating medium discharge conduits 28 arranged in a stellate pattern.

Figure 8:
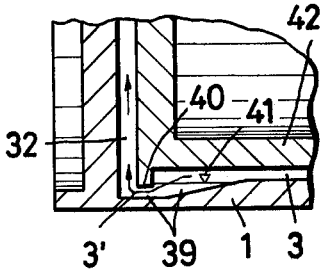
FIG. 8 shows a fragmentary view of the construction according to FIG. 6 in the zone of the operative condensate discharge conduit in a different embodiment.

The condensate collecting in the free annular space 3 between the outer and inner shells is removed without residue only if the diameter of the free annular space 3' in the zone of the stellate discharge conduits 28 is larger than in the zone of the remaining shell surface, and, if possible, larger than the inner diameter of the outer shell 1. Thus, an annular groove is cut into the outer shell 1 in the zone of the discharge conduits, the heating medium discharge conduits extending into this groove. This embodiment is illustrated in FIG. 6. In FIG. 8, a type of siphon pipe is formed in the zone of the discharge conduits 28, by connecting the free annular space 3 by way of a siphon-type elbow 39 with the respective discharge conduit 28, 32. The elbow is formed by a radial annular projection 40 at the end of the inner shell 2, extending into the annular chamber 3' and being larger in its diameter than the inner diameter of the outer shell 1. Thereby, the steam pressure will always be effective on the level 41 of condensate, which may be formed at that location, and the condensate will be forced in total from the operative condensate conduit 32 into the central backflow line 33.

What is claimed is:

1. A heated roll for the heat treatment of materials during rotation about its axis, which comprises an outer cylindrical shell, an inner cylindrical shell, said inner shell being spaced from the outer shell, wall means defining an annular space between said shells, partition means in said annular space for forming flow channels for a heating medium passing through said annular space, feed means for introducing the heating medium into said annular space and discharge means for discharging the heating medium from said annular space and from said roll, said discharge means comprising a centrally located backflow conduit means and defining a single stationary discharge opening arranged in said roll below said roll axis for discharging heating medium selectively from a lower portion of said roll to said centrally located backflow conduit means.

2. A roll according to claim 1, wherein a pipe stationary with respect to the outer shell of said roll is provided with said discharge opening.

3. A roll according to claim 1, wherein said discharge opening is a suction opening of a stationary discharge conduit disposed in the immediate vicinity of said outer roll shell.

4. A roll according to claim 3, wherein said suction opening is arranged below a horizontal plane through said roll axis.

5. A roll according to claim 1, wherein said discharge opening is a suction opening provided by a conduit means arranged vertically below said roll axis.

6. A roll according to claim 1, wherein said discharge means further includes a single rotating conduit that connects the annular space in fluid communication with said centrally located backflow conduit means via said stationary discharge opening.

7. A roll according to claim 6, wherein said rotating conduit is always arranged on the underside of the roll when in fluid communication with said centrally located backflow conduit means.

8. A roll according to claim 7, wherein said wall means includes end walls at each extremity of said roll and said discharge means includes a plurality of discharge conduits arranged in a stellate pattern and disposed in one end wall of the roll, said rotating conduit comprising that one of said plurality of discharge conduits which is located at the very lower most portion of the roll in fluid communication with the centrally located backflow conduit means.

9. A roll according to claim 8, wherein a stationary sealing cap is arranged at one end of said centrally located backflow conduit means, said sealing cap providing a surface that seals a plurality of said rotating discharge conduits which are arranged radially in one end of the roll and said sealing cap having a connecting line on an underside portion which defines said discharge opening and which places said single rotating conduit in fluid communication with said centrally located backflow conduit means.

10. A roll according to claim 9, wherein said connecting line is arranged in the sealing cap vertically below said roll axis.

11. A roll according to claim 9, wherein said discharge opening of said connecting line is larger than a cross section of one of said plurality of discharge conduits.

12. A roll according to claim 11, wherein said discharge opening is larger than the space between two adjacent discharge conduits whereby said two adjacent discharge conduits are placed in fluid communication with said centrally located backflow conduit means via said discharge opening and said connecting line.

13. A roll according to claim 12, wherein the discharge opening of the connecting line in the sealing cap is approximately equal to the cross section of a discharge conduit and the area between two adjacent discharge conduits.

14. A roll according to claim 9, wherein said sealing cap is arranged under a pressure relief in that said sealing cap has both end faces under the effect of the same fluid pressure.

15. A roll according to claim 16, wherein the annular space has an outer diameter in the zone of the discharge conduits that is larger than the diameter in a zone subjacent to the remaining peripheral surface of the roll.

16. A roll according to claim 15, wherein the diameter at the end of the discharge conduit associated with said annular space is equal to or larger than the inner diameter of the outer shell.

17. A roll according to claim 6, wherein said annular space is connected via a siphon-type connection with a discharge conduit.

18. A roll according to claim 1, wherein one end of said roll is supported and said discharge opening is arranged at the other end of said roll.

19. A roll according to claim 1, wherein one end of said roll is supported and said discharge opening is a suction opening of a discharge conduit arranged at the other end of the roll.

20. A roll according to claim 1, further comprising an interior wall positioned at right angles to the roll axis and being spaced from the outer shell to further define an end portion of said annular space for formation of said flow channels therein, and said discharge opening being provided in a discharge conduit that extends through said interior wall.

21. A roll according to claim 20, wherein a heating medium discharge chamber is formed between said interior wall and a roll lid arranged in parallel thereto and providing one end wall of said roll.

22. A roll according to claim 21, wherein a plurality of said flow channels within said annular space is connected with said heating medium discharge chamber.

23. A roll according to claim 21, wherein the entrance to each of said flow channels is arranged in the annular space defined by said interior wall and said outer shell.

24. A roll according to claim 23, wherein said feed means includes a plurality of individual feed lines provided in said interior wall.

25. A roll according to claim 24, wherein said individual feed lines are defined by radial bores extending in said interior wall.

26. A roll according to claim 22, wherein said feed means includes a plurality of heating medium feed lines having outlet openings communicating with said flow channels within said annular space, portions of said flow channels surrounding said outlet openings being formed and being closed off by said partition means from said heating medium discharge chamber.

27. A roll according to claim 26, wherein at one end of said roll in the zone of each outlet opening of the individual heating medium feed lines, a flow channel is initially formed by being closed-off on three sides by said partition means.

28. A roll according to claim 27, wherein at the other end of said roll each of said flow channels is connected to a backflow channel arranged in parallel thereto.

29. A roll according to claim 28, wherein on both sides of each of said flow channels a backflow channel is connected to the flow channel and is disposed in parallel thereto.

30. A roll according to claim 28, wherein the backflow channel extends into said heating medium discharge chamber.

31. A roll according to claim 28, wherein said partition means forming said backflow channels extend to a zone adjacent to the heating medium feed lines positioned within the adjacent flow channels.

32. A roll according to claim 28, wherein said partition means forming said backflow channels terminate before reaching the heating medium discharge chamber.

33. A roll according to claim 28, wherein baffles for the production of turbulence are provided in said flow channels.

34. A roll according to claim 33, wherein said partition means includes partition walls, the ends of said partition walls forming said flow channels being bent at an angle to provide said baffles.

35. A roll according to claim 20, wherein said interior wall rotates with said roll and a bearing element including sealing means is centrally provided, wherein a stationary heating medium discharge pipe is supported.

36. A roll according to claim 35, wherein said heating medium discharge pipe comprises said centrally located backflow conduit means.

37. A roll according to claim 36, wherein said heating medium feed means includes a feed pipe that surrounds said centrally located heating medium discharge pipe.

38. A roll according to claim 37, wherein a free end of said heating medium feed pipe is connected with a flanged lid which is connected with said interior wall.

39. A roll according to claim 38, wherein axis openings in communication with the heating medium feed pipe are provided in the interior wall adjacent to the flanged lid, said axial openings being connected in fluid communication with the heating medium feed conduits.

40. A roll according to claim 38, wherein the inner diameter of the outer roll shell forming the heating medium discharge chamber is larger than the inner diameter of the outer roll shell in the zone of the flow channels within said annular space.

* * * * *